US007370711B2

(12) United States Patent
Singh

(10) Patent No.: US 7,370,711 B2
(45) Date of Patent: May 13, 2008

(54) ROLLING CONE DRILL BIT HAVING NON-CIRCUMFERENTIALLY ARRANGED CUTTER ELEMENTS

(75) Inventor: Amardeep Singh, Houston, TX (US)

(73) Assignee: Smith International, Inc., Houston, TX (US)

( * ) Notice: Subject to any disclaimer, the term of this patent is extended or adjusted under 35 U.S.C. 154(b) by 186 days.

(21) Appl. No.: 11/203,863

(22) Filed: Aug. 15, 2005

(65) Prior Publication Data

US 2007/0034411 A1 Feb. 15, 2007

(51) Int. Cl.
*E21B 10/08* (2006.01)
*E21B 10/18* (2006.01)

(52) U.S. Cl. ..... 175/77; 175/378; 175/341

(58) Field of Classification Search ..... 175/374, 175/377, 378, 341, 77
See application file for complete search history.

(56) References Cited

U.S. PATENT DOCUMENTS

| | | | | | |
|---|---|---|---|---|---|
| 2,687,875 | A | | 8/1954 | Morlan et al. | |
| 3,401,759 | A | * | 9/1968 | White | 175/341 |
| 3,726,350 | A | | 4/1973 | Pessier | |
| 4,187,922 | A | | 2/1980 | Phelps | |
| 4,304,440 | A | | 12/1981 | Posciri | |
| 4,334,586 | A | | 6/1982 | Schumacher | |
| 4,393,948 | A | * | 7/1983 | Fernandez | 175/374 |
| 4,408,671 | A | | 10/1983 | Munson | |
| 4,420,050 | A | * | 12/1983 | Jones | 175/374 |
| 4,815,342 | A | | 3/1989 | Brett et al. | |
| 4,832,136 | A | | 5/1989 | Mattsson et al. | |
| 4,936,398 | A | | 6/1990 | Auty et al. | |
| 4,940,099 | A | | 7/1990 | Deane et al. | |
| 4,984,643 | A | * | 1/1991 | Isbell et al. | 175/341 |
| RE34,167 | E | | 1/1993 | Mattsson et al. | |
| 5,224,560 | A | | 7/1993 | Fernandez | |
| 5,372,210 | A | * | 12/1994 | Harrell | 175/431 |
| 5,429,201 | A | | 7/1995 | Saxman | |
| 5,456,328 | A | | 10/1995 | Saxman | |
| 5,697,462 | A | * | 12/1997 | Grimes et al. | 175/374 |
| 5,839,526 | A | | 11/1998 | Cisneros et al. | |
| 6,131,676 | A | | 10/2000 | Friant et al. | |
| 6,161,634 | A | | 12/2000 | Minikus et al. | |

(Continued)

FOREIGN PATENT DOCUMENTS

EP 593268 4/1994

OTHER PUBLICATIONS

Combined Search and Examination Report for Appl. No. GB0615906.5 dated Dec. 8, 2006; (5 p.).

*Primary Examiner*—Frank Tsay
(74) *Attorney, Agent, or Firm*—Conley Rose, P.C.

(57) ABSTRACT

A rolling cone drill bit including multiple cones with regions of intermeshing and non-intermeshing cutter elements. In the non-intermeshed regions, an array of cutter elements is disposed about the cone surface in a non-circumferential arrangement with the cutter elements being mounted at differing radial distances from the bit axis. This non-circumferential arrangement, which may be a spiral, multiple spirals, other patterns of offset cutter elements, or a random arrangement, provides a composite cutting profile having substantial width and bottomhole coverage and is free of ridge-producing voids. In certain embodiments, the composite cutting profiles of the arrays at least partially overlap, and may be arranged to cover a portion of or the entire non-intermeshed region on the cones.

38 Claims, 12 Drawing Sheets

U.S. PATENT DOCUMENTS 6,176,329 B1 1/2001 Portwood et al.
6,415,687 B2 7/2002 Saxman
6,484,824 B2 * 11/2002 Skyles ..... 175/341
6,834,733 B1 12/2004 Maouche et al.
6,988,569 B2 1/2006 Lockstedt et al.
7,059,431 B2 * 6/2006 Simon et al. ..... 175/377
2002/0017401 A1 2/2002 Xiang et al.
2004/0045743 A1 3/2004 Lockstedt et al.
2004/0118609 A1 6/2004 Dennis
2006/0219442 A1 * 10/2006 Felderhoff et al. ..... 175/331

* cited by examiner

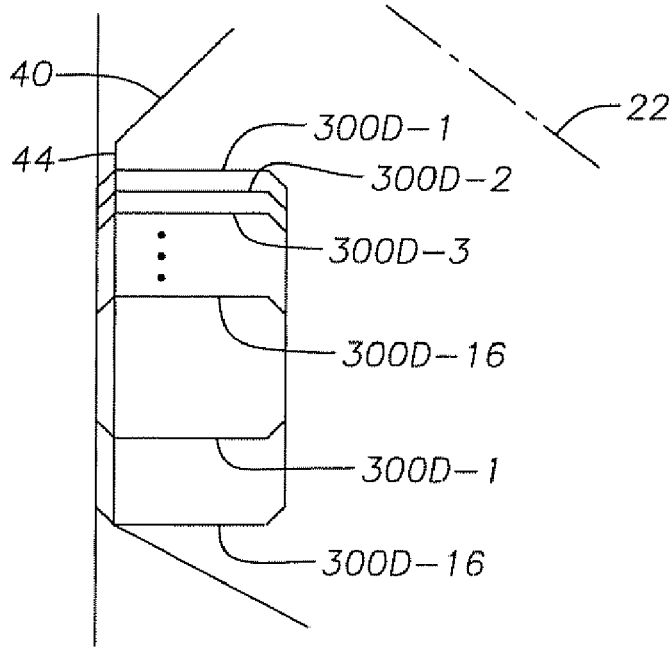
Fig. 13
Fig. 14A
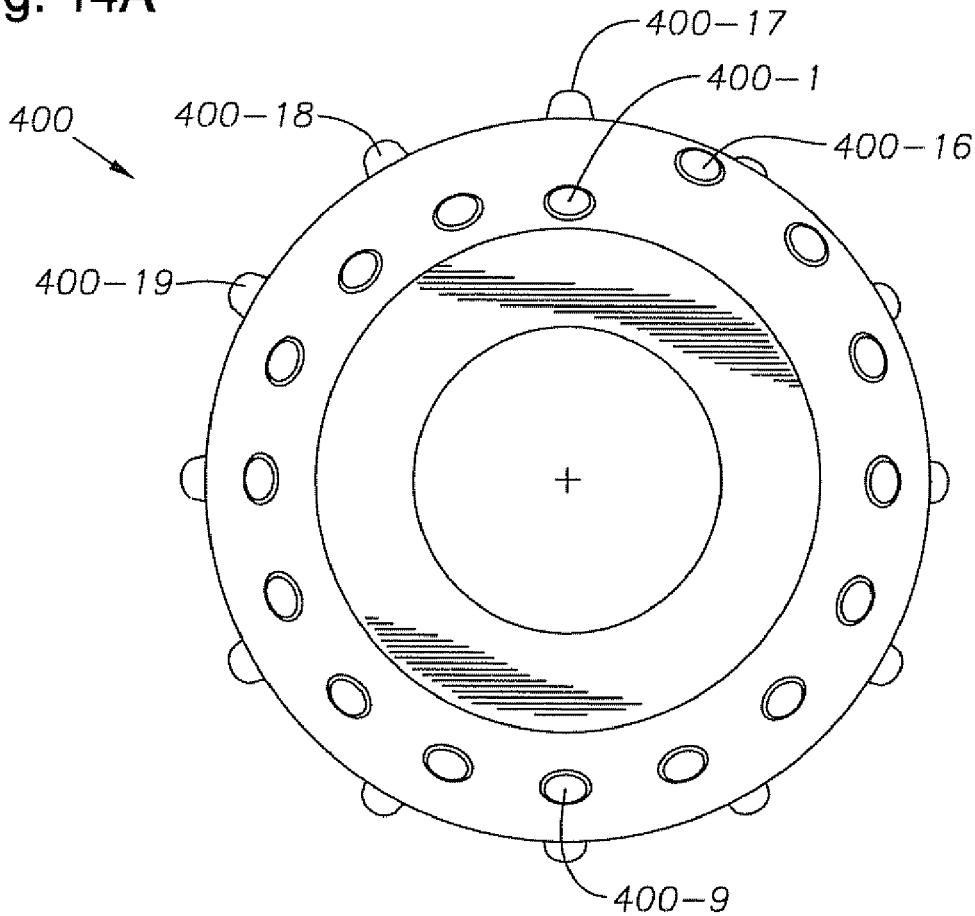

ROLLING CONE DRILL BIT HAVING NON-CIRCUMFERENTIALLY ARRANGED CUTTER ELEMENTS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutter element placement so as to decrease the likelihood of bit tracking.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutter elements on the rotating cutters break up the formation to form the new borehole by a combination of gouging and scraping or chipping and crushing.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. The form and positioning of the cutter elements upon the cone cutters greatly impact bit durability and ROP, and thus are critical to the success of a particular bit design.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearings, and ultimately lead to bit failure.

Conventional bits also typically include one or more rows of gage cutter elements. Gage cutter elements are mounted adjacent to the heel surface but orientated and sized in such a manner so as to cut the corner of the borehole. In this orientation, the gage cutter elements generally are required to cut both the borehole bottom and sidewall. The lower surface of the gage cutter elements engage the borehole bottom, while the radially outermost surface scrapes the sidewall of the borehole.

Conventional bits also include a number of additional rows of cutter elements that are located on the cones in rows disposed radially inward from the gage row. These cutter elements are sized and configured for cutting the bottom of the borehole and are typically described as inner row cutter elements and, as used herein, may be described as bottom-hole cutter elements. Such cutters are intended to penetrate and remove formation material by gouging and fracturing formation material. In many applications, inner row cutter elements are relatively long and sharper than those typically employed in the gage row or the heel row where the inserts ream the sidewall of the borehole via a scraping or shearing action.

A condition detrimental to efficient and economical drilling is known as "tracking." Tracking occurs when the inserts or cutting teeth of a cone cutter fall into the same depressions or indentations that were made by the bit during a previous revolution. Tracking creates a pattern of hills and valleys, known as "rock teeth" or "rock ribs," on the bottom of the borehole. This pattern may closely match the pattern of the cutter elements extending from the cone cutters, making it more difficult for the cutter elements to reach the uncut rock at the bottom of the valleys. Thus, tracking prevents the cutter elements from fully and efficiently penetrating and disengaging the formation material at the bottom of the borehole. Because the cutter elements penetrate into an indentation previously formed, rather than making a fresh indentation that is offset from prior indentations, the disintegration action of the cutting elements is less efficient. In part, this is because the weight-on-bit is distributed to the flanks of the cutter elements, rather than to the relatively sharp crests of the cutter elements. Thus, tracking slows the drilling process and makes it more costly.

Further, the sculptured pattern on the borehole bottom may tend to redistribute the weight-on-bit from the cutter elements to the surface of the cone cutters. This not only impedes deep penetration of the cutter elements, but may lead to damage to the cone and the cone bearings. Such damage may occur because the cone itself becomes more directly exposed to significant impact or transient loads which may tend to cause premature seal and/or bearing failure. Thus, tracking is known to seriously impair the penetration rate, life and performance of an earth boring bit.

Increasing ROP while maintaining good cutter and bit life to increase the footage drilled is an important goal in order to decrease drilling time and recover valuable oil and gas more economically. Decreasing the likelihood of bit tracking would further that desirable goal.

Accordingly, there remains a need in the art for a drill bit and cutting structure that tends to prevent tracking so as to yield an increase in ROP and footage drilled, and eliminate other detrimental effects.

SUMMARY OF THE PREFERRED EMBODIMENTS

Accordingly, there is described herein a rolling cone drill bit including multiple cones with regions of intermeshing and non-intermeshing cutter elements. In the non-intermeshed regions, an array of cutter elements is disposed in a band extending about the cone surface. The array is a non-circumferential arrangement, with the cutter elements being mounted at nonuniform radial distances relative to the bit axis. This non-circumferential arrangement, which may be a spiral, multiple spirals, other patterns of staggered or offset cutter elements, or a random arrangement, provides a composite cutting profile having substantial cutting width, and one that is free of ridge-producing voids. In certain embodiments, the composite cutting profiles of the arrays at least partially overlap, and may be arranged to cover the entire non-intermeshed region on the cones or only some portion of that region. Arrays in which the cutter elements have non-uniform radial positions and thus are non-circumferentially arranged provide enhanced bottomhole coverage, and offer the potential to reduce the likelihood of bit tracking. These and various other features and characteristics of above-mentioned arrays, cone cutters and drill bits are described in more detail below, and will be readily understood and appreciated upon reading the following detailed description of the preferred embodiments, and by referring to the accompanying drawings

BRIEF DESCRIPTION OF THE DRAWINGS

For a more detailed description of the preferred embodiment of the present invention, reference will now be made to the accompanying drawings, wherein:

FIG. 13 is a partial section view showing, schematically and in rotated profile, the cutting profiles of certain cutter elements of the cone cutter shown in FIG. 12.

FIG. 14A is an elevation view of another cone cutter that may be employed in the rolling cone bit of FIGS. 1 and 2 as viewed looking toward the backface of the cone cutter.

DETAILED DESCRIPTION OF THE PREFERRED EMBODIMENTS

Figure 1:
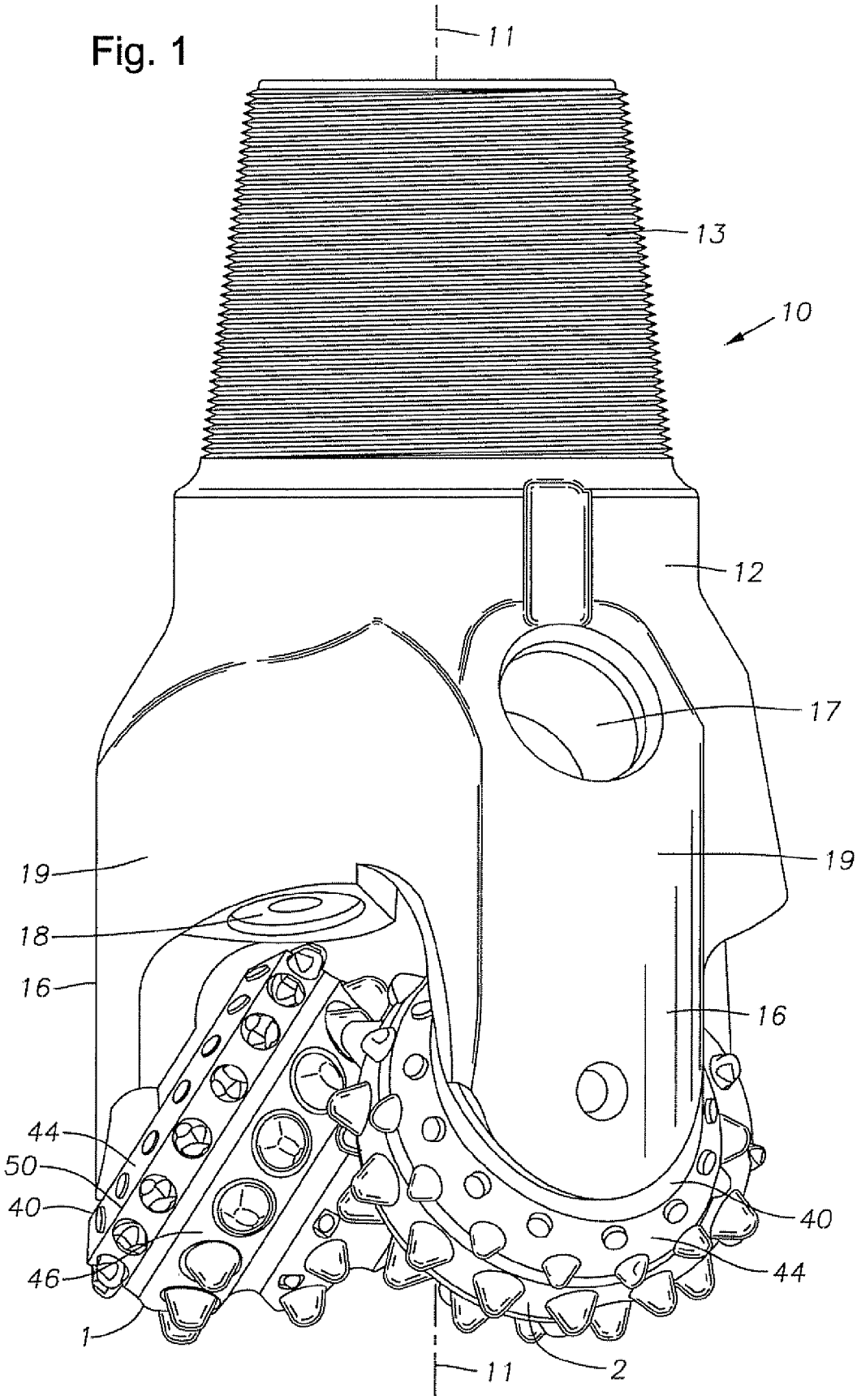
FIG. 1 is a perspective view of an earth-boring bit made in accordance with the principles of the present invention.

Referring first to FIG. 1, an earth-boring bit 10 is shown to include a central axis 11 and a bit body 12 having a threaded section 13 at its upper end that is adapted for securing the bit to a drill string (not shown). Bit 10 has a predetermined gage diameter as defined by the outermost reaches of three rolling cone cutters 1, 2, 3 (cones 1 and 2 shown in FIG. 1) which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage caused by cuttings and debris entering between leg 19 and its respective cone cutter.

Figure 2:
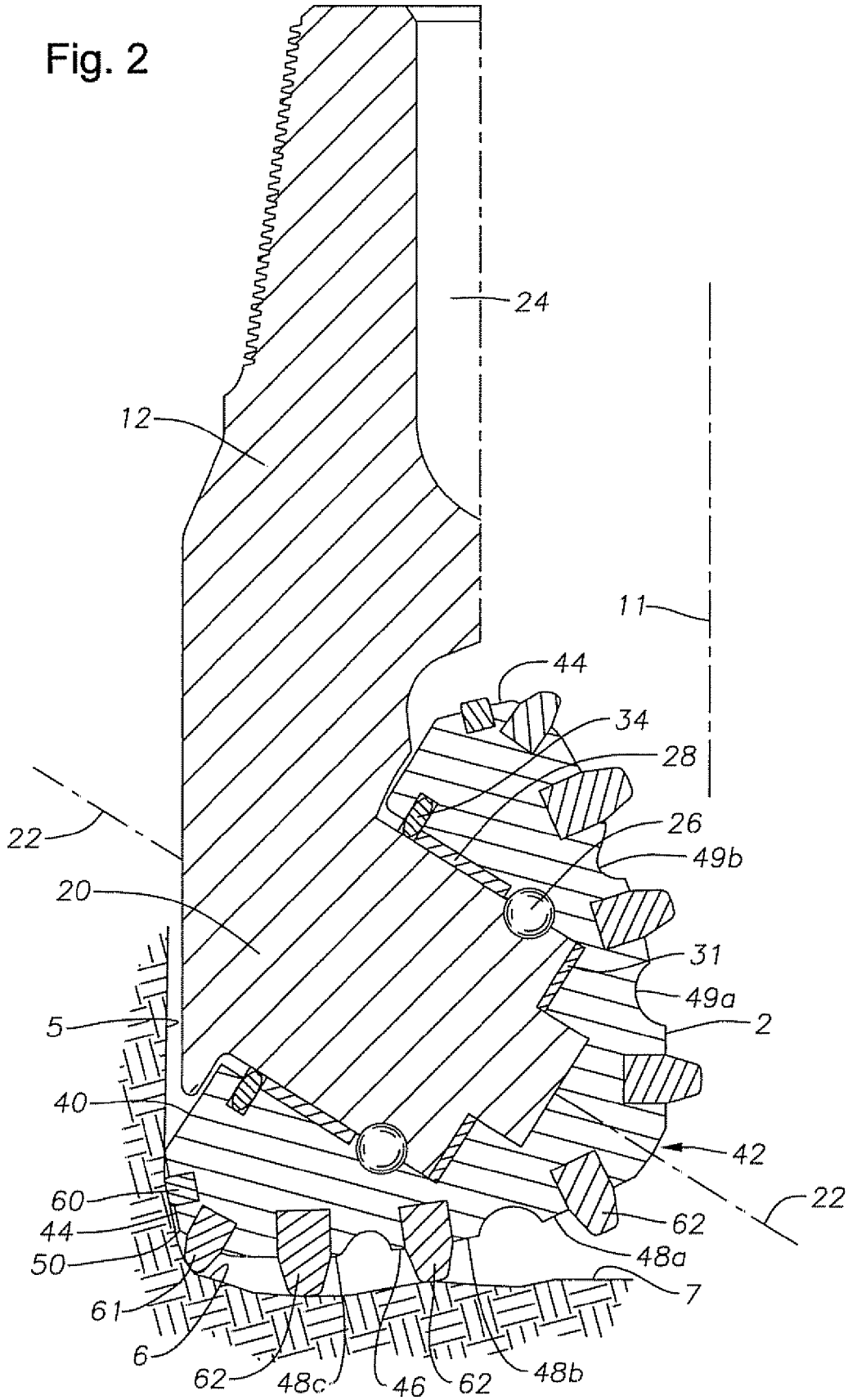
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by journal sleeve 28 and thrust washer 31. The bearing structure shown is generally referred to as a journal bearing or friction bearing; however, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Cone 2 includes three such lands 48*a-c*. Grooves 49 are formed in cone surface 46 between adjacent lands 48*a-c*.

In the bit shown in FIGS. 1 and 2, each cone cutter 1-3 includes a plurality of wear resistant inserts 60, 61, 62, 63. These inserts each include a generally cylindrical base portion with a central axis, and a cutting portion that extends from the base portion and includes a cutting surface for cutting formation material. The cutting surface may be symmetric or asymmetric relative to the insert axis. All or a portion of the base portion is secured by interference fit into a mating socket drilled into the surface of the cone cutter. The "cutting surface" of an insert is defined herein as being that surface of the insert that extends beyond the surface of the cone cutter. The extension height of the cutter element is the distance from the cone surface to the outermost point of the cutting surface (relative to the cone axis) as measured parallel to the insert's axis.

Figure 3A:
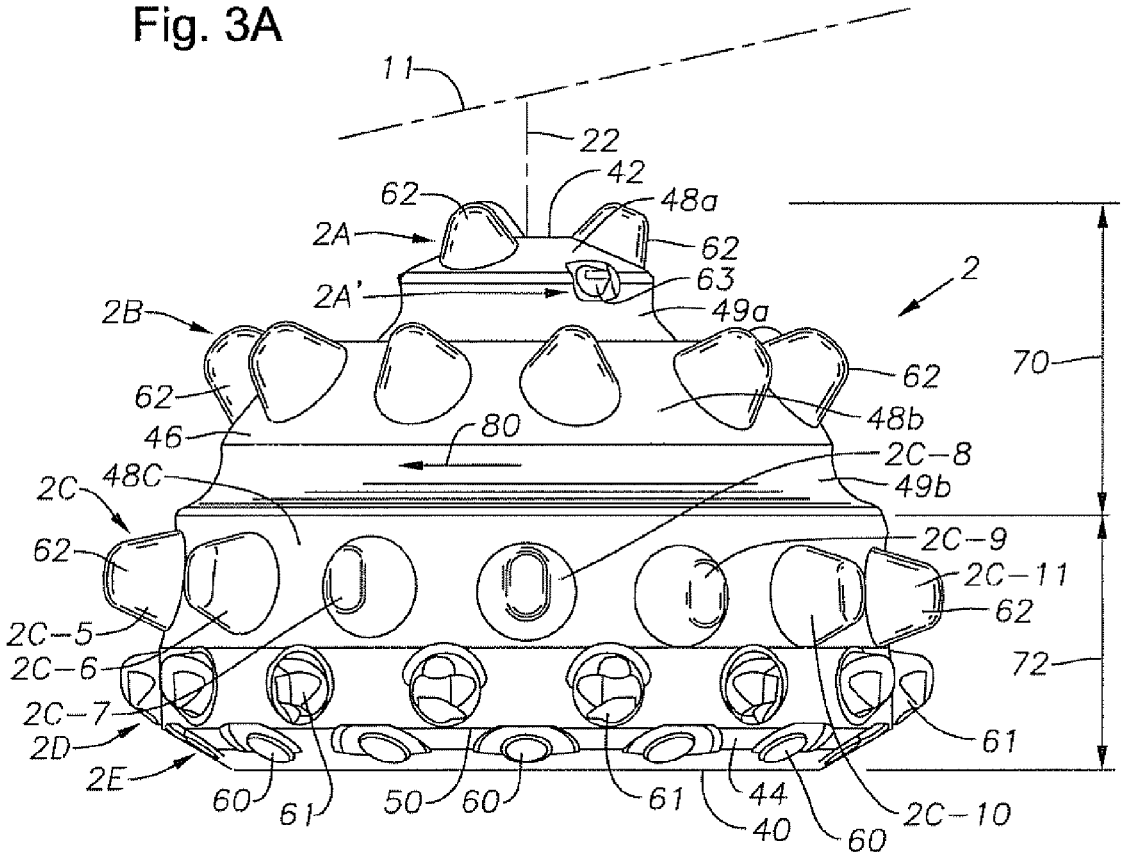
FIGS. 3A and 3B are, respectively, front and rear elevation or profile views of one of the cone cutters of the bit shown in FIGS. 1 and 2.
Figure 3B:
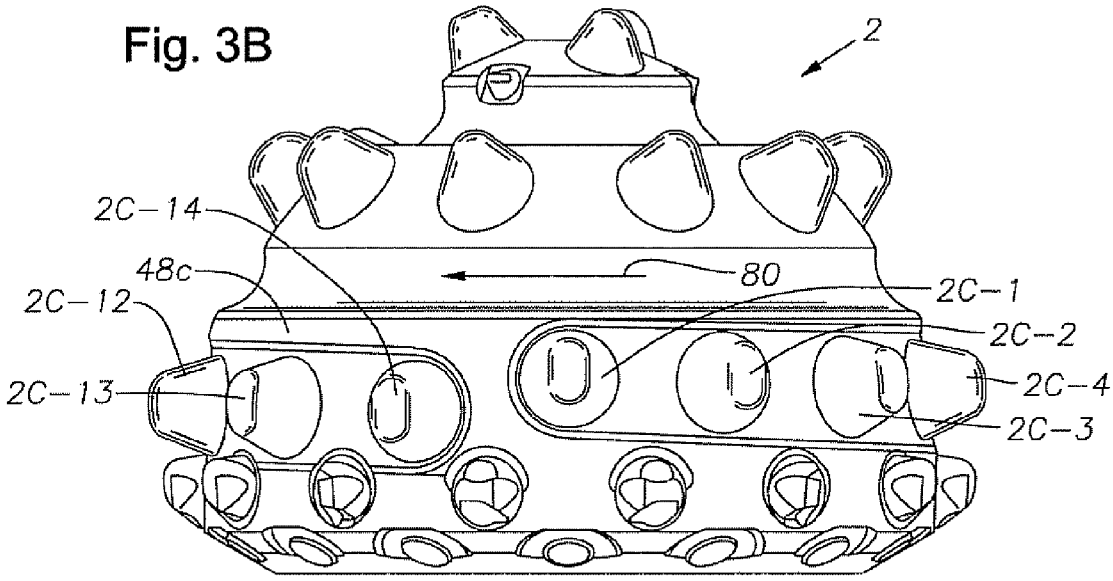

Referring now to FIGS. 3A and 3B, cone cutter 2 is shown in more detail and generally includes a substantially planar backface 40 and a nose 42 opposite backface 40. Cone cutter 2 further includes a generally frustoconical heel surface 44 adjacent to backface 40 and a generally conical surface 46 extending between heel surface 44 and nose 42. Cone 2 further includes a circumferential row of heel cutter elements 60 extending from heel surface 44. In this embodiment, heel row cutter element 60 are generally flat-topped elements designed to ream the borehole sidewall.

Adjacent to shoulder 50 and radially inward of the heel row cutters, cone 2 includes a circumferential row of gage cutter elements 61. In this embodiment, elements 61 include a cutting surface having a generally slanted crest and are intended for cutting the corner of the borehole 6 (FIG. 2), although any of a variety of cutter elements may be employed in this location. Cone cutting inserts 61 are referred to herein as gage or gage row cutter elements. However, others in the art will describe such cutter elements as heel cutters or heel row cutters.

Between the circumferential row of gage cutter elements 61 and nose 42, cone cutter 2 includes a number of rows and other arrangements of bottomhole cutter elements 62. Bottomhole cutter elements 62 are intended primarily for cutting the bottom of the borehole and, for example, may include cutting surfaces having a generally rounded chisel shape as shown in FIGS. 3A, 3B, although other shapes may be employed.

Cone 2 further includes a plurality of ridge cutter elements 63 (one each shown in the views of FIGS. 3A and 3B). Ridge cutter elements 63 are intended to cut portions of the hole bottom 7 that are otherwise left uncut by cutting paths of the other bottomhole cutter elements 62.

Referring again to FIG. 3A, the cutter elements disposed on cutter 2 may generally be described as being disposed or positioned in six different groupings or arrangements. For example, cone cutter 2 includes a nose row 2A which includes three substantially identical bottomhole cutter elements 62 that are mounted in the cone cutter at nominally the same radial position so that these cutter elements 62 cut in a single swath or track in the formation. Likewise, cone cutter 2 includes a row 2B of bottomhole cutter elements 62. All cutter elements of row 2B are of substantially similar size and shape, and each is located in the same nominal radial position so as to form a circumferential row 2B that is spaced apart from row 2A. Disposed between row 2A and row 2B is a row 2A' including a plurality of ridge cutter elements 63.

Continuing to move toward the backface 40, cone cutter 2 includes an array 2C of bottomhole cutter elements 62. As described in more detail below, the cutter elements of array 2C are not disposed in a circumferential row as are the elements of rows 2A and 2B where, within manufacturing tolerances, the row's elements are mounted in the same radial position and therefore may be referred to herein as being redundant cutter elements or as being located in redundant positions. The cutter elements of array 2C are instead disposed in non-uniform radial positions (relative to the bit axis 11) such that the cutter elements in array 2C do not cut in an identical paths but instead cut in offset or staggered paths. Having this arrangement, the cutter elements of 2C are described as being non-circumferentially arranged, and are therefore arranged differently than in the conventional arrangement where they are placed in circumferential rows. Adjacent to array 2C are the gage row cutter elements 61 which, in this embodiment, are arranged in a circumferential row 2D. The heel surface 44 retains a circumferential row 2E of heel row cutter 60.

An annular groove 49*a* separates row 2A from row 2B. Likewise, a groove 49*b* is disposed between row 2B and array 2C. Grooves 49*a*, b permit cleaning of the cone cutter by allowing fluid flow between the adjacent rows of cutters, and further permits the cutter elements from adjacent cone cutters 1, 3 to intermesh with the cutter elements of cone 2.

More specifically, performance expectations of rolling cone bits require that the cone cutters be as large as possible within the borehole diameter so as to allow use of the maximum possible bearing size and to provide a retention depth adequate to secure the cutter element base within the cone steel. To achieve maximum cone cutter diameter and still have acceptable insert retention and protrusion, some of the rows of cutter elements are arranged to pass between the rows of cutter elements on adjacent cones as the bit rotates. In some cases, certain rows of cutter elements extend so far that clearance areas or grooves corresponding to cutting paths taken by cutter elements in these rows are provided on adjacent cones so as to allow the bottomhole cutter elements on adjacent cutters to intermesh farther. The term "intermesh" as used herein is defined to mean overlap of any part of at least one cutter element on one cone cutter with the envelope defined by the maximum extension of the cutter elements on an adjacent cutter. Thus, grooves 49*a* and 49*b* allow the cutting surfaces of certain bottomhole cutter elements 62 of cone cutters 1 and 3 to pass between the cutter elements of rows 2A and 2B, and between row 2B and array 2C without contacting cone surface 46 of cone cutter 2.

In this way, cone cutter 2 may therefore be described as being divided into an intermeshed region 70 and a non-intermeshed region 72. In particular, rows 2A and 2B of cone cutter 2 lie in the intermeshed region 70, while the cutter elements of arrangements 2C, 2D and 2E are in the non-intermeshed region of cone cutter 2.

In the embodiment shown in FIGS. 3A and 3B, the cutter elements of array 2C are not retained in the cone cutter at the same radial position, but instead are located in differing radial positions. In this particular embodiment, each cutter element 62 of array 2C is disposed in a different radial position. For purposes of further explanation, each of the inner row cutter elements 62 of array 2C are assigned reference numerals 2C-1 through 2C-14, there being fourteen cutter elements 62 in array 2C in this embodiment. Cutter elements 2C-1 through 2C-14 are disposed on a generally frustoconical-shaped region or band 48*c* which encircles the cone and which is located in the non-intermeshed region 72 between the circumferential row 2D of gage row cutter elements and the circumferential row 2B of the intermeshed region 70.

Figure 4:
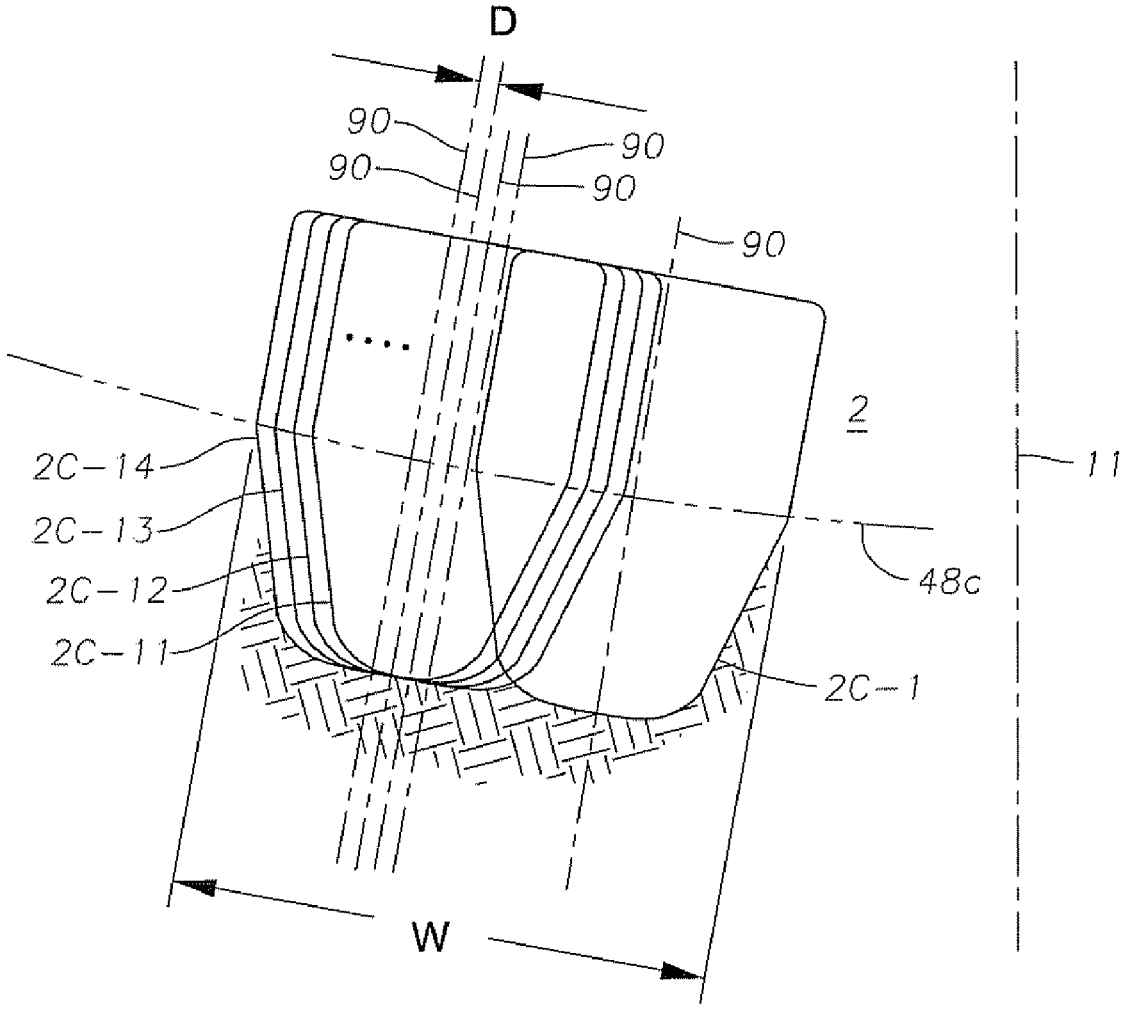
FIG. 4 is a partial schematic view showing, in rotated profile, the cutting paths of certain of the cutter elements disposed in the cone cutter shown in FIGS. 3A and 3B.

As cone cutter 2 rotates in the borehole in the direction represented by arrow 80, cutter elements 2C-1 through 2C-14 periodically hit the borehole bottom, with each hit intended to dislodge a volume of the formation material in order to advance the borehole. When the cutting surfaces of cutter elements 2C-1 through 2C-14 are viewed as they would appear if rotated into a single plane, hereafter referred to as "viewed in rotated profile," the cutter surfaces of the elements are positioned as shown in FIG. 4. In this enlarged view, it can be seen that the cutter element 2C-14 includes a cutting surface that cuts the closest to the borehole wall while cutter element 2C-1, the radially-innermost cutter element of the array, has a cutting surface that cuts closest to the bit axis 11 and furthest from the borehole wall. The profiles of elements 2C-2 through 2C-10 have been omitted for clarity. It will nevertheless be understood that cutter elements 2C-2 through 2C-13 cut at locations radially between cutter elements 2C-1 and 2C-14. This array 2C of cutter elements, where a series of adjacent elements are positioned progressively further (or closer) to the bit axis, is generally described herein as a spiral arrangement or spiral array.

In this specific arrangement, the radial positions of the cutter elements 2C-1 through 2C-14 are staggered equally. In other words, the cutter element axis 90 of each of the cutter elements 2C-1 through 2C-14 is spaced a uniform radial distance D from the element axis of the immediately adjacent cutter elements. In this example, where elements 2C-1 through 2C-14 have a diameter of 0.5625 inch, D is equal to approximately 0.015 inches. Other radial positions and offsets may be employed. Preferably, for bits having diameters of between 7⅞ inch and 8¾ inch, D will be between approximately 0.010 inches and 0.100 inches.

Likewise, in this embodiment, each of the fourteen cutter elements 2C-1 through 2C-14 are angularly spaced about the cone axis 22 25.70°; however, as desired or required for clearance with other inserts, the angular positioning of the cutter elements 2C-1 through 2C-14 need not be uniform. In the rotated profile shown in FIG. 4, the inserts are positioned in the cone at a uniform angle of 0.5° relative to the bit axis 11 and generally perpendicular to the cone surface. However, in other embodiments, that angle may be more or less, and the angle need not be uniform among all cutter elements of an array. The composite cutting profile represented by the overlapping cutting profiles of cutter elements 2C-1 through 2C-14 has a width W as measured generally normal to the surface of frustoconical region 48*a* in this rotated profile.

As cone 2 rotates in the borehole, cutter elements 2C-1 through 2C-14 will cut substantially the entire width W of the adjacent formation. In particular, the array will cut a swath, leaving no uncut borehole bottom, at least between the cutter element axes of the radially-innermost and outermost cutter elements. In other words, the cutter elements are positioned closely enough such that, in rotated profile, uncut ridges of formation are not formed between the adjacent cutting positions within the composite profile. By contrast, and referring momentarily in to FIG. 7, it can be seen that ridges R of formation material may form between the adjacent and concentric circumferential rows of cutter elements in the intermeshed region 70. The overlapping and relatively close positioning, in rotated profile, of the cutter elements in array 2C shown in FIG. 4 prevents ridges from forming. For this reason, the array 2C and its rotated profile W may be fairly described as being free of cutting voids or ridge-producing voids.

Additionally, as perhaps best understood with reference to FIGS. 3B and 4, given the substantial radial distance that exists between the various cutter elements in array 2C as a particular cutter element comes into engagement with the formation, the likelihood that the cutting tip of that element will fall within a previously-formed crater or indentation is lessened such that the cone cutter will tend not to track.

Figure 5A:
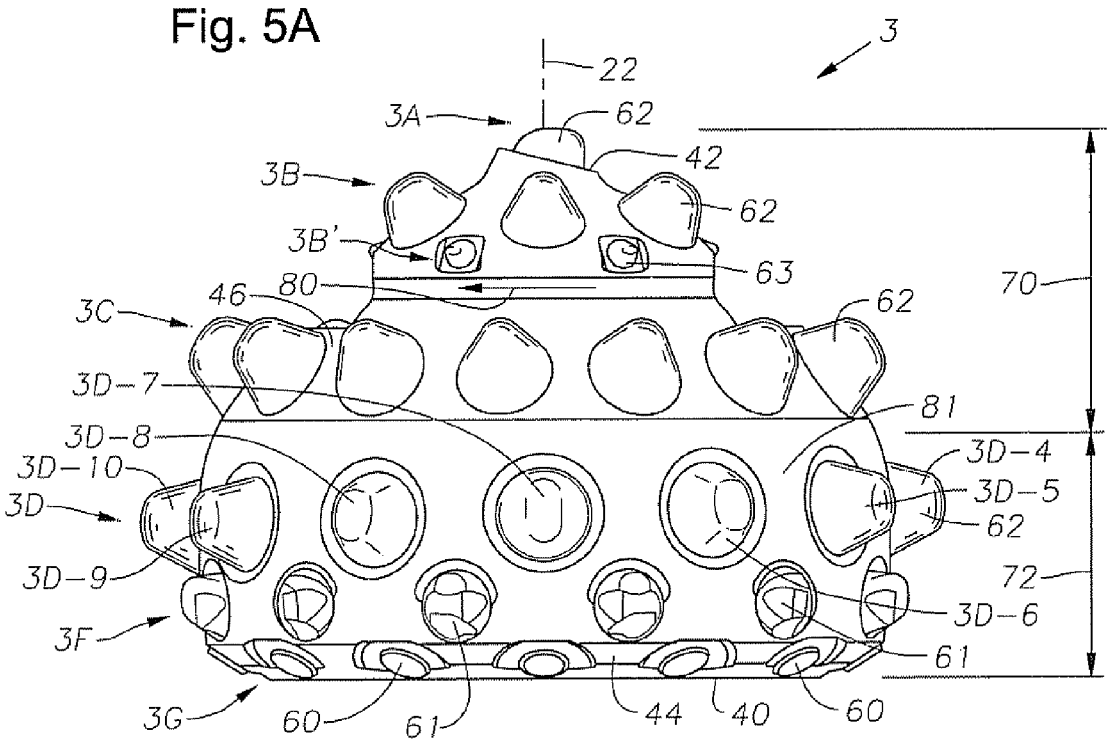
FIGS. 5A and 5B are, respectively, front and rear elevation or profile views of another of the cone cutters of the bit shown in FIGS. 1 and 2.
Figure 5B:
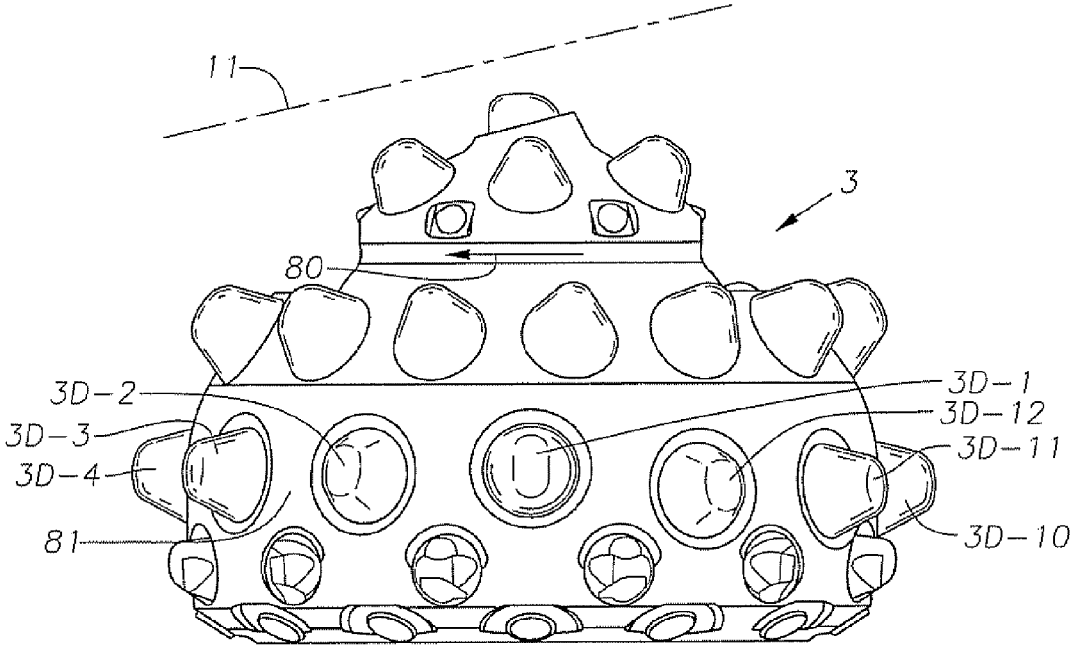

Referring now to FIGS. 5A and 5B, cone 3 includes backface 40, nose 42, generally frustoconical heel surface 44, and generally conical surface 46. Likewise, cone 3 includes heel inserts 60, gage inserts 61, bottomhole inserts 62 and ridge cutter elements 63, all as previously described. Bottomhole cutter elements 62 are arranged in a first row 3A (consisting of a single insert), a spaced-apart circumferential row 38, and another spaced-apart circumferential row 3C. In this embodiment, within each row 38 and 3C, all of the elements have substantially the same radial position and have overlapping and aligned cutting profiles and element axes. Disposed between rows 3B and 3C is a circumferential row 3B" of ridge cutting elements 63. Like cone 2, cone 3 includes a circumferential row 3G of heel inserts 60 spaced apart from a circumferential row 3F of gage inserts 61.

Disposed between gage row 3F and inner row 3C is frustoconical region or land 81 upon which are arranged an array 3D of twelve bottomhole cutter elements 62, referenced herein as elements 3D-1 through 3D-12. Rows 3A through 3C intermesh with rows of bottomhole cutter elements in cones 1 and 2 such that the region 70 may be described as the intermeshed region on cone 3, and the region 72 being the non-intermeshed region. As best shown in FIG. 5B, cutter element 3D-1 is positioned closest to bit axis 11 while cutter element 3D-12 is furthest from bit axis 11. Between those cutter elements, elements 3D-2 through 3D-11 are mounted with each being at a different radial position and with each being progressively further from bit axis 11 forming a spiral array of elements. Relative to the direction of cone rotation 80, this array 3D of cutter elements 3D-1 through 3D-12 spirals in the opposite direction from the spiral arrangement of cutter elements in array 2C on cone 2, previously described.

Figure 6A:
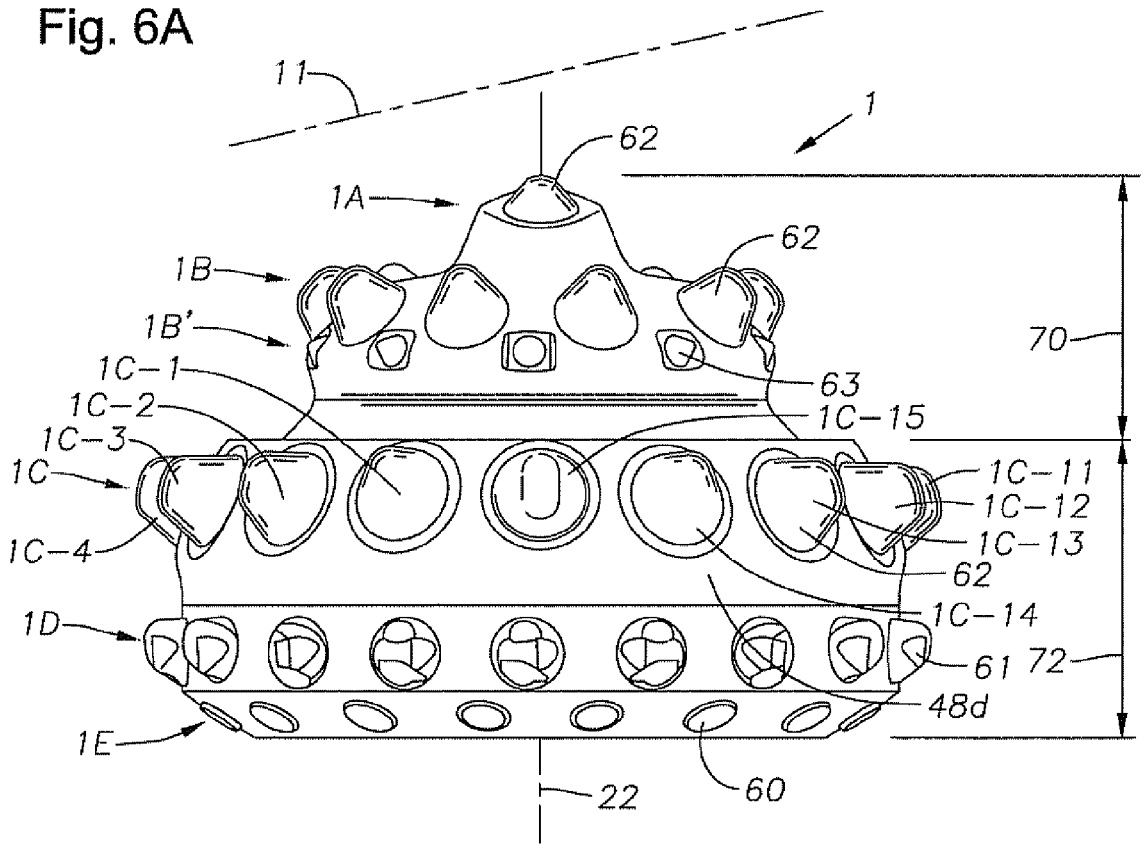
FIGS. 6A and 6B are, respectively, front and rear elevation or profile views of another of the cone cutters of the bit shown in FIGS. 1 and 2.
Figure 6B:
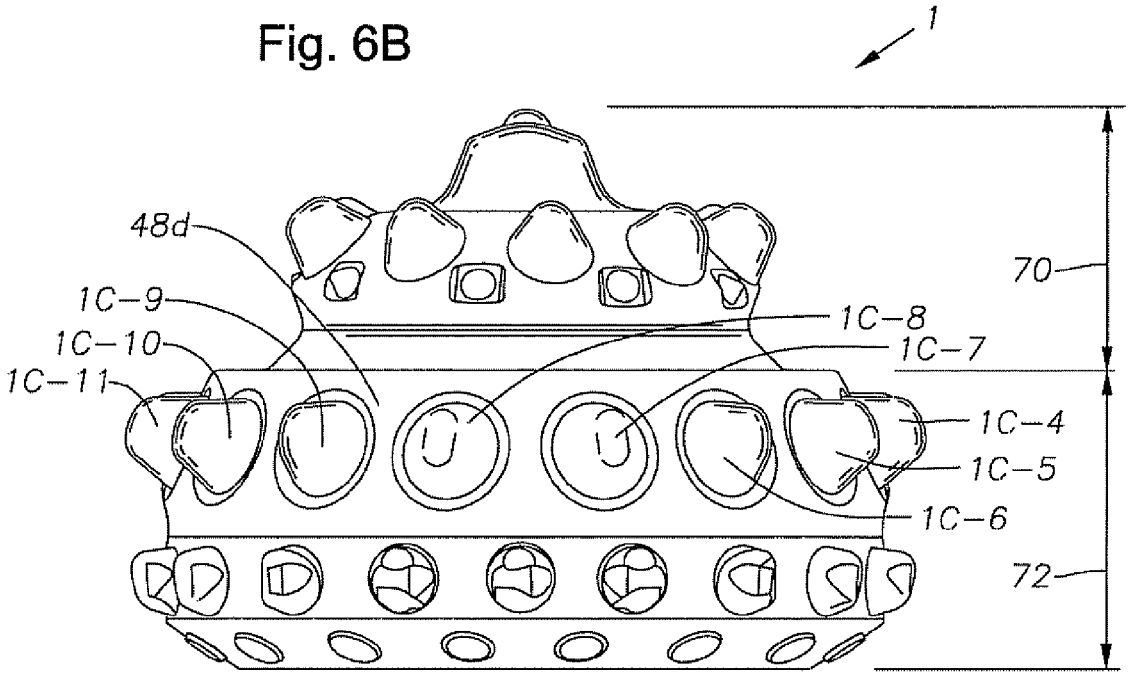

Referring now to FIGS. 6A and 6B, cone 1 includes backface 40, nose 42, generally frustoconical heel surface 44, and generally conical surface 46. Likewise, cone 1 includes heel inserts 60, gage inserts 61, bottomhole inserts 62, and ridge cutter elements 63, all as previously described. Bottomhole cutter elements 62 are arranged in a first row 1A (consisting of a single insert) and a spaced-apart circumferential row 1B. All of the cutter elements in row 1B nominally have the same radial position and have overlapping and aligned cutting profiles and element axes. A circumferential row 1B' of ridge cutting elements 63 is disposed adjacent row 1B. Cone 1 also includes a circumferential row 1E of heel inserts 60, spaced apart from a circumferential row 1D of gage inserts 61.

Between gage row 1D and inner row 1B' is frustoconical region **48*d* upon which are arranged an array 1C of fifteen bottomhole cutter elements 62, referenced here as elements 1C-1 through 1C-15. Rows 1A and 1B intermesh with rows of bottomhole cutter elements 62 in cones 2 and 3 such that the region 70 may be described as the intermeshed region on cone 1, and the region 72** being the non-intermeshed region.

Array 1C includes fifteen inner row cutter elements 62 arranged in two separate spiral arrangements. Referring to FIG. 6A, cutter elements 1C-1 and 1C-15 are disposed closest to the bit axis 11 and are disposed at the same radial position in this example and thus are redundant cutter elements. In relation to these two cutter elements, cutter elements 1C-2 through 1C-8 are positioned in a spiral, each being progressively further from bit axis 11. Cutter elements 1C-14 through 1C-8 likewise are positioned progressively further from bit axis 11 and are positioned in a spiral arrangement, but one that spirals in the opposite direction. Thus, the cutter elements of the array 1C are arranged in two spirals (of eight elements each) that spiral in opposite directions. In this fifteen cutter element array, cutter element 1C-8, the cutter element furthest from bit axis 11, is part of each spiral.

Referring again to FIG. 7, there is shown, in rotated profile, the cutting profiles of each of the cutter elements of cones 1-3. The single nose row cutter of cone 3 represents a cutting profile 3A. Likewise, the single nose row cutter from cone 1 is represented by profile 1A which is spaced radially inward from profile 3A. Cutting profiles of each of the cutter elements in rows 2A, 3B, 1B, 2B and 3C are represented by a single cutting profile having the same designation. Likewise, the circumferential rows of ridge cutter elements are each represented by a single cutting profile 2B', 3B', and 1B' given that each of the cutter elements in the respective rows are generally aligned.

The cutter elements of the array 1C of cone 1 (having the two, oppositely directed, spiral arrangements) is represented by profile 1C. The profiles of arrays 2C and 3D are likewise shown. The cutting profiles of the fifteen cutter elements of array 1C form eight spaced-apart cutting profiles as two of the cutter elements in each of the separate spiral arrangements are positioned in the same position, and one cutter element is common to both spirals. Particularly, the cutting profile designated as 1C-1 is identical to the profile for redundant cutter element 1C-15. The cutter element designated 1C-8 is the sole cutter element having a cutting profile in that position.

With respect in cutting profile of elements of array 2C, each of the fourteen cutter elements are spaced at a different radial position, such that fourteen separate cutting profiles combine to create the composite cutting profile 2C. Cutter element C-1 is the radially-innermost cutter element of the array 2C. Likewise, the twelve, radially-spaced cutter elements in arrayy 3D collectively define the composite profile 3D. In this embodiment it is evident that a substantial number of cutter elements (twenty-six in this example) are available for bottombole cutting in the region immediately adjacent to gage cutter element 61, given the overlap of the cutter elements in each array 3D and 3C, as well as the overlap between the two composite cutting profiles 3D and 2C. In this arrangement not only is there substantial overlap between the cutting profiles of 3D and 2C, but there is also overlap between the cutting profiles of 3D with 1C and of 2C with 1C regions. Thus, this example demonstrates overlap, in rotated profile, of the composite cutting profile of cutter arrays of three cone cutters. The total composite cutting profile of these three arrays totally covers the borehole bottom from the cuffing surface of insert 1C-1 to the cutting surface of the radially-outermost cuter element of array 3D, as measured between the element axes of those cutter elements. As shown, due to the spacing of the cutter elements within each array, and due to the overlap of the composite cutting profiles of the arrays, no uncut bottom exists and no uncut ridges will be formed between the elements of arrays 1C and 3D. The total composite cutting profile may therefore be described as free of cutting voids or free of ridge-producing voids. In this example, the total composite cutting profile spans or encompasses the entire region between the intermeshed cutter elements and the gage row cutter elements. As will be described below, in other embodiments, the total composite cutting profile that is free of cutting voids may extend to include the gage region and heel region, such that all regions of the cone cutters, excluding the intermeshed regions, will be free of cutting voids.

Figure 7:
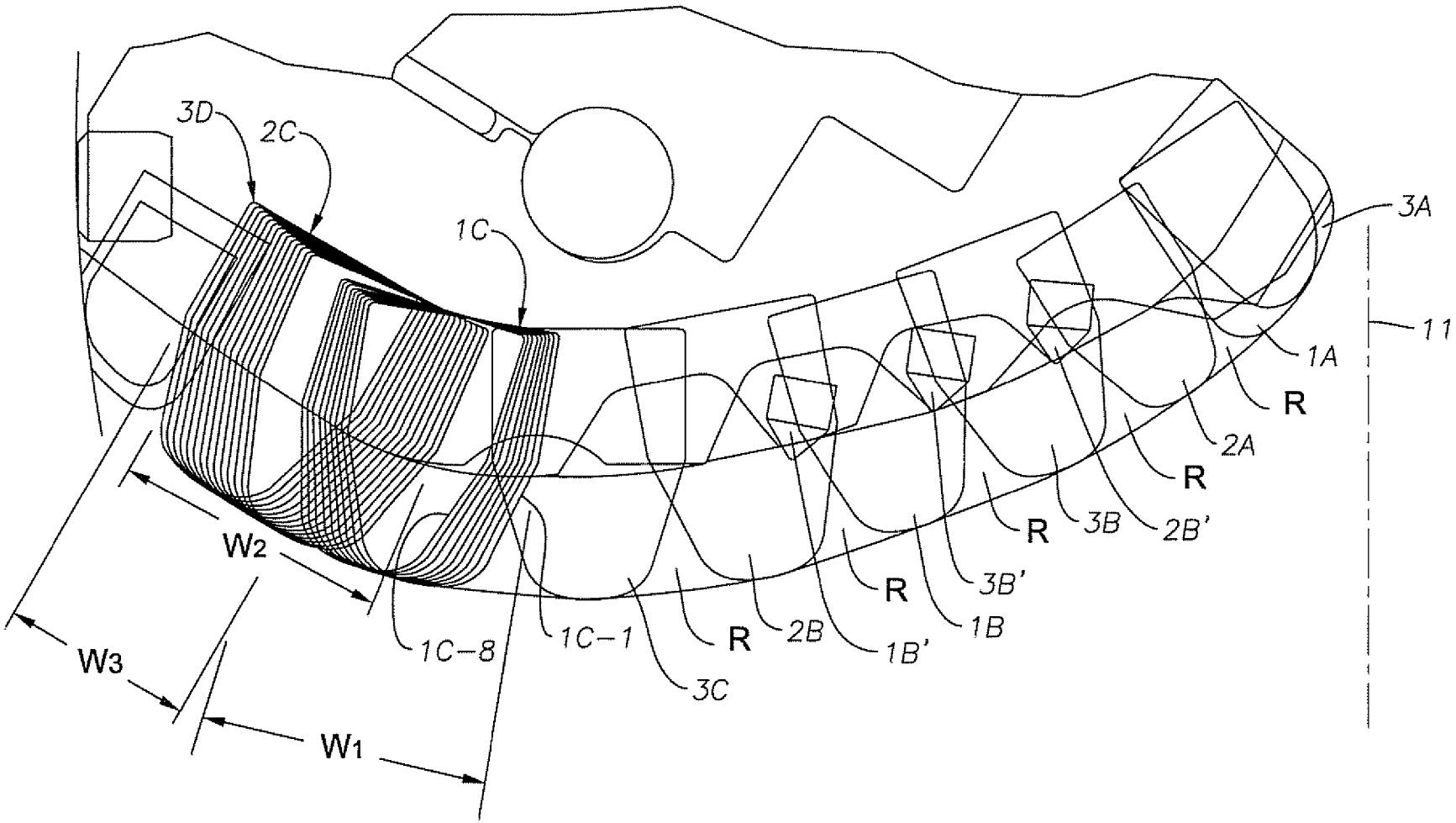
FIG. 7 is a partial section view showing, schematically and in rotated profile, the paths of all of the cutter elements of the three cone cutters of the drill bit shown in FIG. 1.

As can further be understood with reference to FIG. 7, a bit may be designed with more or less space available for the gage row cutter elements depending, in part, on the spacing of the radially-outermost array of bottomhole cutter elements (array 3D in this example). As will be understood, if array 3D is positioned to overlap more with the array of 2C, or if array 3D is configured with some elements in redundant radial positions (such as arranged into the eight positions in the example of array 1C), then greater room will be afforded the gage cutter elements. In that instance, the gage row cutter elements may have a greater diameter. Likewise, the gage insert, given the latitude afforded by its position relative to the closest bottomhole array, may have a different extension height, a different or more desirable cutting shape, or be made with a different material or material enhancement. Similarly, varying the width and degree of overlap between the composite cutting profile of the nearest array of bottomhole cutter elements provides the bit designer with more latitude in the positioning of the gage cutter elements relative to the hole wall (engaging either higher or lower on the hole wall) and in the number of gage inserts that may be employed in the gage row. In a corresponding manner, the size, number, diameter, extension, shape and materials of the heel row cutter elements may likewise be varied on a single cone, and from cone to cone, depending upon the size, arrangement, and composite cutting profile of the gage row cutter elements.

Figure 8:
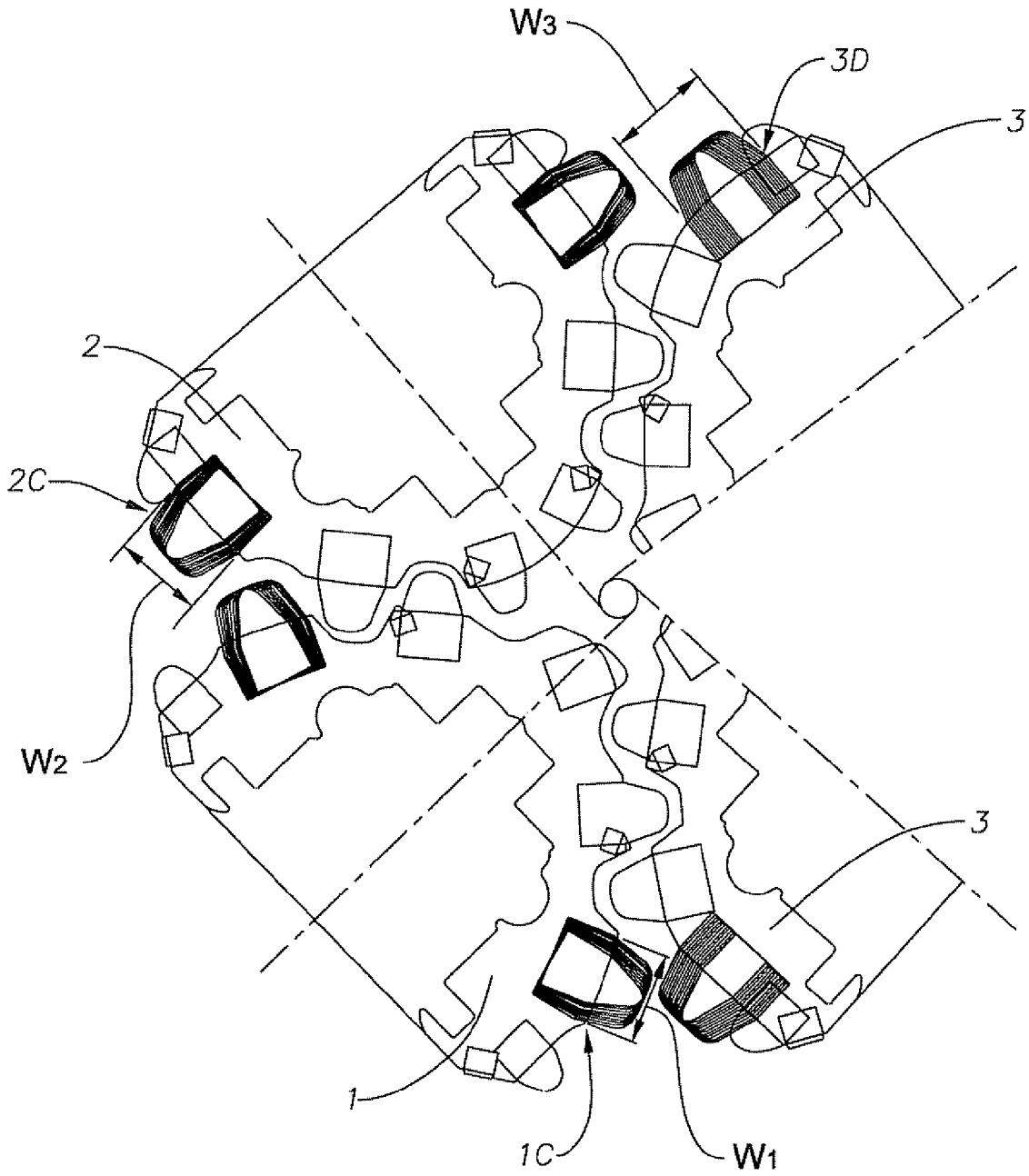
FIG. 8 is a schematic representation showing a cross-sectional view of the three rolling cones of the bit shown in FIG. 1.

Referring momentarily to FIG. 8, the intermeshed relationship between the cones 1-3 is shown. In this view, commonly termed a "cluster view," the schematic representation of cone 3 is duplicated so that the intermesh between cones 2 and 3 and between cones 1 and 3 may be depicted. As shown in FIG. 8, in the intermeshed regions 70, the cutter elements of cones 1-3 are arranged in circumferential rows of elements where the elements of each row are disposed at substantially the same radial position. Outside or radially distant from the intermeshed region 70 is the non-intermeshed region 72 in which substantial bottomhole coverage is provided by the spiral arrays 1C, 2C and 3D, previously described. The composite cutting profile of the arrays 1C, 2C and 3D as shown to have cutting widths $W_1$, $W_2$ and $W_3$, respectively. In this embodiment, $W_2$ of array 2C is larger than $W_1$ of array 1C, and $W_1$ is larger than $W_3$ of array 3D.

Although the arrays of cutter elements 1C, 2C and 3D have been depicted and described as spirals, other arrangements may be employed and still achieve expanded bottomhole coverage and, simultaneously, be positioned so as to potentially lessen the likelihood of tracking. More particularly, and referring, for example, to FIG. 4, the same number of cutter elements may be employed in frustoconical region 48*c* and be positioned so that their cutting surfaces, in rotated profile, cover the entire width W without the elements being positioned in a spiral. For example, cutter elements 2C-1 through 2C-14 may be disposed each at a different radial position so that, in rotated profile, the entire width W of frustoconical region 48*c* is covered. However, instead of cutter elements 2C-1 thorough 2C-14 following each other in the numerically consecutive manner shown, those cutter elements may be randomly positioned about surface 48*c* so that the cutter elements do not progress in a spiral from the radially innermost cutter element to the radially outermost cutter element, but that still creates the same composite cutting profile shown in FIG. 4.

Similarly, and referring to FIGS. 6A and 6B of cone 1, the same complete coverage of frustoconical surface 48*d* could be maintained with the cutter elements of the array 1C differently positioned. As a specific example, instead of arranging the cutter elements in two separate spirals, pairs of cutter elements having the same radial position could be positioned adjacent to one another so that, upon moving about the cone axis 22 along frustoconical surface 48*d*, there would first be two cutter elements having the same innermost radial position, followed by two cutter elements having the next innermost radial position, and so on, until the final cutter element in the outermost radial position (cutter element 1C-8 shown in FIG. 6B) would be positioned. Numerous other arrangements are possible. Arrays in which the cutter elements have non-uniform radial positions and thus are non-circumferentially arranged provides both enhanced bottomhole coverage and, significantly, offers the potential to lessen the likelihood of tracking occurring. In the non-uniform position of cutter elements of a given array, it is unlikely that, as the bit rotates in the borehole and the elements of the array rotate back to the formation-engaging position, they will impact the borehole bottom in a crater previously made by a cutter element of that array. This is the case both because the cutter elements of the given array are at different radial positions and because the non-intermeshed cutter elements of the various cones are not in the same radial position because their composite cutting profiles overlap.

This non-circumferential arrangement of cutter elements may also lead to additional enhancements in bit design. For example, referring now to FIG. 9, there is schematically shown a cone cutter 100 including bottomhole cutter elements disposed in nose circumferential row 100A, a second circumferential row of bottomhole cutter elements 100B, a spiral array 100C of bottomhole cutter elements, a circumferential row 100D of gage cutter elements, and a circumferential heel row 100E. As shown, array 100C includes a spiral arrangement of fourteen cutter elements, cutter elements 100C-1 to 100C-7 shown in FIG. 9, in which each cutter element is positioned at a radially different location than the other elements in the array. Cutter element 100C-7 is closest to gage, while cutter 100C-1 is furthest from gage and closest to bit axis 11. Although the radial distance between adjacent elements of the array is exaggerated in this Figure, it will be understood that in a location such as the position of 100C-1, there is substantially greater volume of cone steel and room for larger gage inserts, as compared to the region where element 100C-7 is positioned. This enables the cone cutter 100 to employ gage row cutters of non-uniform diameter. Specifically, gage insert 100D-1 may be significantly larger in diameter than gage insert 100D-7. In particular, in addition to this design's antitracking potential, by providing gage inserts of larger diameter, the cone cutter 100 may be more robust and durable in its corner cutting capabilities, as compared to a cone cutter in which all of the gage row cutter elements are of a single and smaller diameter.

Figure 9:
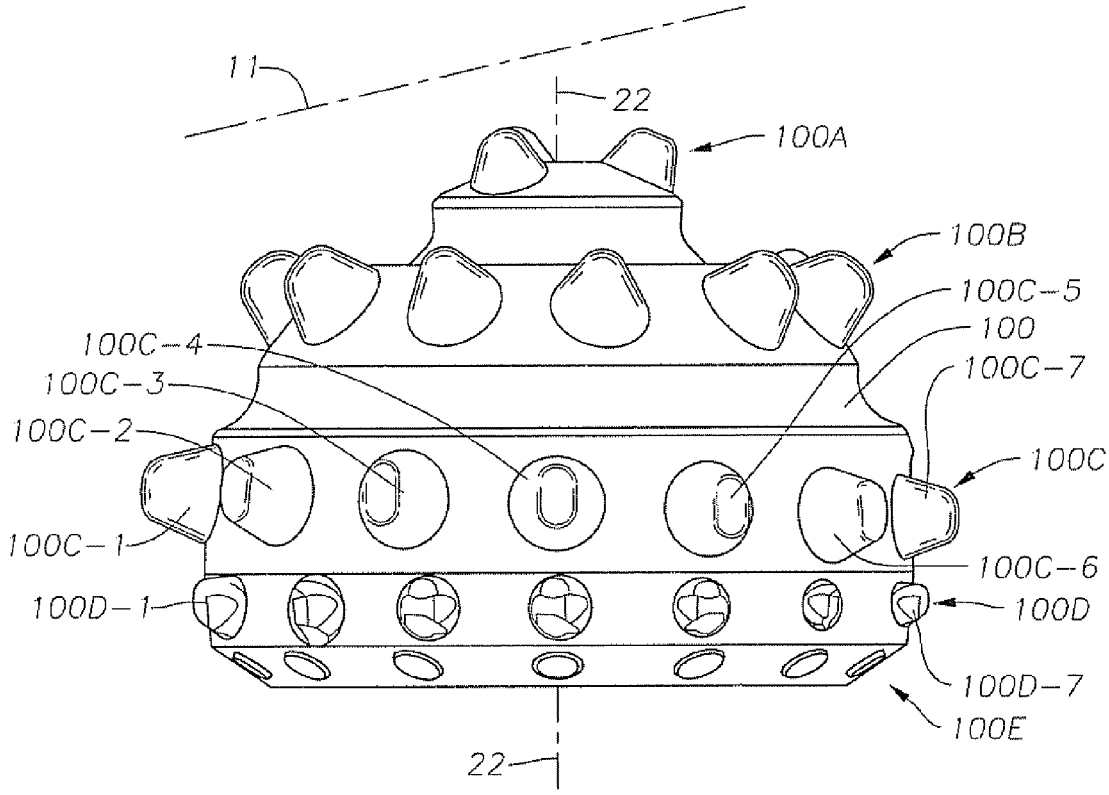
FIG. 9 is an elevation view of another cone cutter having application in a rolling cone bit such as the bit of FIGS. 1 and 2.

Additionally, and still referring to FIG. 9, by placing the cutter elements in array 100C in differing radial positions, the cutter elements will endure differing forces as they engage formation material. For example, the radially innermost cutter element 100C-1, being closer to the bit axis, will experience more impact loading and can be made more durable relative to insert 100C-7. In this particular example, insert 100C-7 is very close to gage row and, as such, will experience and engage in shearing cutting duty. In this application, it is desirable that the cutter element 100C-7 be made harder and more wear-resistant, as compared to cutter element 100C- 1. As such, in this example, insert 100C-7 may be made of a harder, more wear-resistant grade of carbide, or other material, while insert 100C-1 may be made of a tougher, more durable material.

Further properties of the cutter elements of a given non-circumferential array may be varied depending upon the application. Once again, referring to FIG. 9, for cutting in the position show for cutter element 100C-1, it may be desirable that the cutter element have a greater diameter or greater extension, or both, compared to the cutter element shown as 100C-7. For cutter element 100C-1 that is furthest from gage and intended to have a substantial share of the bottomhole cutting duty, it may be desirable that cutter element 100C-1 be provided with a greater extension height than the cutter element in position 100C-7. Likewise, the shape of the cutter elements in an array may differ. Once again, it may be desirable that the cutter element 100C-1 be an aggressive chisel shape, for example, while the cutter element closer to gage, 100C-7, may have a hemispherical cutting surface or a generally flat cutting surface. In summary, the cutter elements in a non-circumferentially arranged array may differ substantially with regards to insert diameter, extension height, shape of the cutting surface, and material grades and material coatings.

In the foregoing examples, cutter elements are disposed in the non-intermeshed region of the cone cutter in an array intended to prevent the cutter elements from falling within previously-made indentations so as to lessen the likelihood of bit tracking. The composite cutting profiles provided by these arrays further enhances bottomhole coverage by eliminating large, uncut regions. To best resist tracking, it is desired to space the cutter elements of an array of non-circumferentially arranged elements in at least five or more different radial positions. The larger the cone diameter in the region in which the array of elements is to be placed, the greater the number of different radial positions that can be employed. As explained above with respect to cone cutters 2 and 3, for a 7⅞ diameter bit 10, it is useful to employ 7 or more radial positions for cutter arrays that are immediately adjacent and radially inboard from the gage row.

Figure 10:
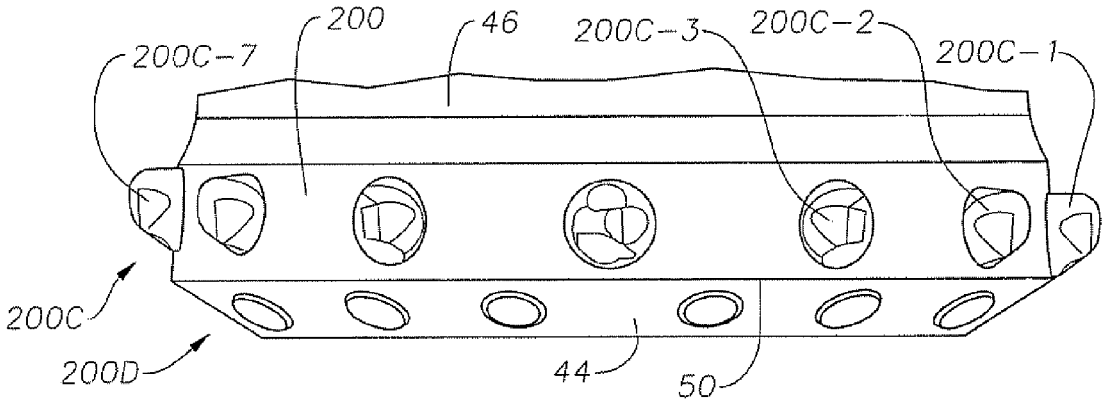
FIG. 10 is a partial elevation view of another cone cutter having application in a rolling cone bit, such as the bit of FIGS. 1 and 2.

In the embodiments described above, the cutter element arrays in the non-intermeshed region extend generally from the outermost row of intermeshed cutter elements to a gage row of cutter elements that is generally adjacent the heel surface. However, these arrays of offset and non-circumferentially arranged cutter elements may continue outwardly so as to encompass the gage region and even the heel region. Referring now to FIG. 10, cone cutter 200 is shown including a generally frustoconical heel surface 44 and a generally conical surface 46, as previously described. The heel surface 44 retains a circumferential row 200D of heel row cutter elements. Adjacent to heel surface 44 is an array 200C of gage cutter elements 200C-1 through 200C-N (only elements C1-C7 being visible in this view). As shown, element 200C-1 is closest to the heel surface 44 with cutters 200C-2 C-N, each positioned progressively ffirther from heel surface 44 (and closer to bit axis 11). In this arrangement, each of the gage cutter elements in array 200C are offset slightly from one another presenting the rotated profile shown in FIG. 11. As shown, each element 200C-1 through 200C-N is positioned slightly lower in the bit and closer to the bit axis II. Collectively, the cutting profiles of the cutter elements of array 200C make a composite profile that overlaps with the composite profile of the array of adjacent bottomhole cutter elements, represented in this figure as $W_b$. It is preferred that the composite cutting profile of array 20CC overlap with the composite profile of $W_b$ so that substantially no ridges can found therebetween.

Figure 12:
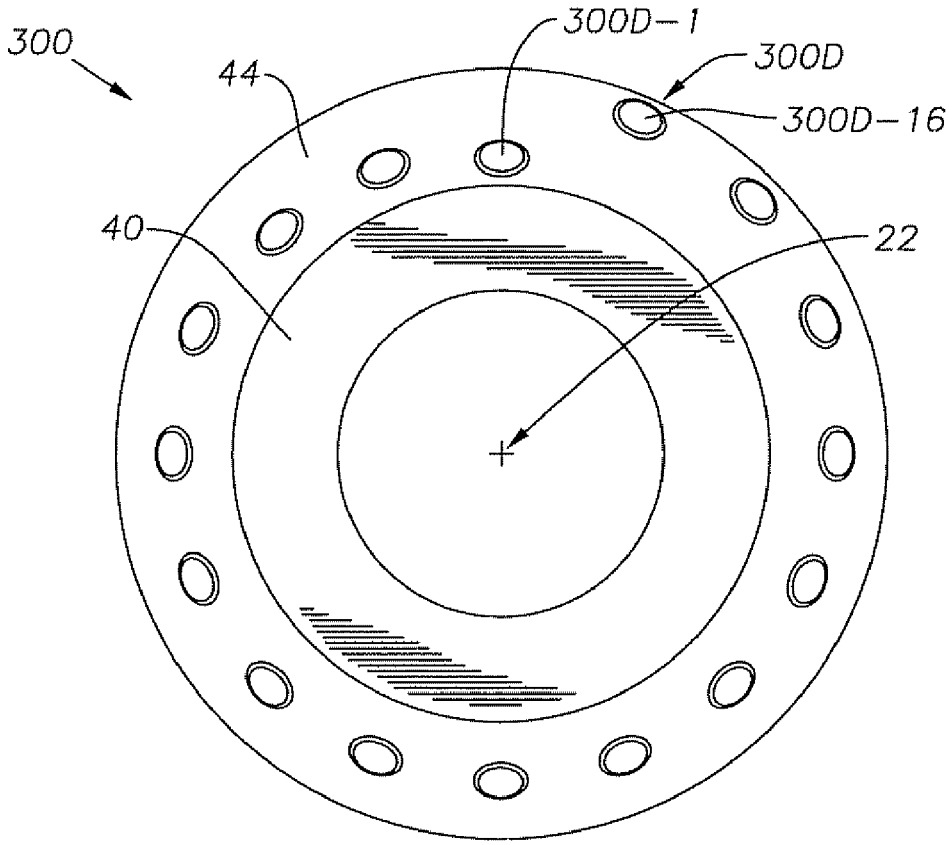
FIG. 12 is an elevation view of another cone cutter that may be employed in the rolling cone bit of FIGS. 1 and 2 as viewed looking toward the backface of the cone cutter.

Referring now to FIG. 12, a cone cutter 300 in shown as viewed from the back of the cone, looking perpendicular to backface 40. Cone cutter 300 includes an array 300D of heel row cutter elements 300D-1 through 300D-16. The heel elements of array 300D are positioned to spiral about the cone axis 22. As shown in FIG. 13, it is desirable that cutter elements 300D be positioned such that the composite cutting profile of array 300D spans substantially the entire width of heel surface 44.

Figure 11:
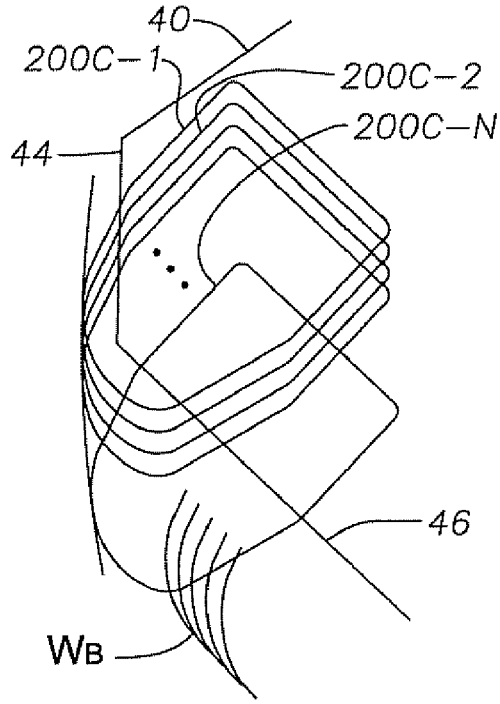
FIG. 11 is a partial section view showing, schematically and in rotated profile, the cutting profiles of certain cutter elements of the cone cutter shown in FIG. 10.
Figure 14B:
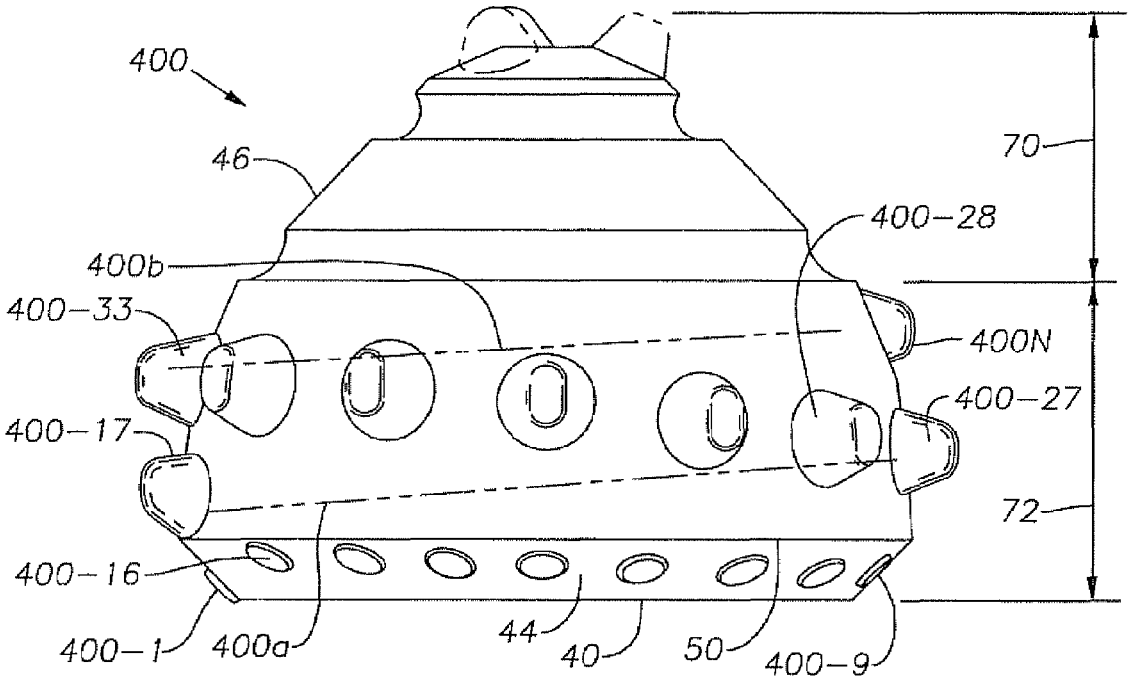
FIG. 14B is a side elevation view, in schematic form, showing the arrangement of cutter elements on the rolling cone cutter of FIG. 14A.

As will be understood, the spiral arrangement of heel cutters of FIGS. 12 and 13 may be combined with the non-circumferential arrangement of gage cutter elements, such as array 200C shown in FIGS. 10 and 11. Furthermore, the above-described concepts also contemplate an arrangement in which an entire non-intermeshed region of a cone cutter is covered by an arrays or arrays of non-circumferentially arranged cutter elements. Put another way, it is contemplated to have arrays of non-intermeshed bottomhole cutter elements arranged to overlap with one another such that the total composite profile includes no cutting voids, and also to have that total composite profile overlap with the composite cutting profile of a non-circumferential arrangement of gage cutter elements. This combination may, alternatively, be combined with a non-circumferential array of heel cutter elements. One such example is shown schematically in FIGS. 14A and 14B. FIG. 14A generally shows the cone cutter 400 from the end view. Cone 400 includes a spiral array of heel cutter elements, including 400-1 through 400-16 substantially similar to that described with reference to FIG. 12. Adjacent to 400-16, but extending from generally conical surface 46 at a location adjacent to circumferential shoulder 50, is a gage cutter element 400-17 that is positioned and configured for cutting the corner of the borehole. As best understood with reference to FIG. 14B, the spiral arrangement of cutter elements that begins on heel surface 44 continues around conical surface 46. Specifically, bottomhole cutter elements are arranged in a spiral along the path generally shown by dashed line 400*a*. In the view shown in FIG. 14B, the spiral array continues on cone surface 46 and includes bottomhole cutter elements 400-27 through 400-33. The spiral arrangement continues along the opposite side of the cone along the path generally shown by dashed line 400*b* with the array ending adjacent to intermeshed region 70 with cutter element 400-N. The intermeshed region 70 includes conventional circumferential rows of bottomhole cutter elements (not shown for purposes of clarity). The precise number and positioning of the cutter elements in the embodiment shown in FIGS. 14A and 14B are not critical, but those that are shown are representative of only one particular arrangement of non-circumferential cutter elements. In this particular embodiment, the spiral arrangement of heel cutter elements 400-1 to 400-16 creates a composite profile that would partially overlap with the composite profile created by the cutter elements positioned on generally conical surface 46 and residing in the non-intermeshed region.

While preferred embodiments of the present invention have been disclosed above with respect to cutter elements that comprise hard metal inserts, the concepts illustrated and discussed in these examples are equally applicable to bits in which the cutter elements are other than inserts, such as metal teeth formed from the cone material, as in steel tooth bits. Other modifications and adaptations of what has been specifically disclosed can be made by one skilled in the art without departing from the spirit or teaching herein. Thus, the embodiments described herein are exemplary only and are not limiting. Many variations and modifications of the above-described structures are possible and are within the scope of the invention. Accordingly, the scope of protection is not limited to the embodiments described herein, but is only limited by the claims which follow, the scope of which shall include all equivalents of the subject matter of the claims.

What is claimed is:

1. A drill bit for drilling through earthen formations and forming a borehole, the bit comprising:

a bit body having a bit axis;

at least a first and a second cone cutter, each cone cutter being mounted on said bit body and adapted for rotation about a different cone axis, said first cone cutter comprising a backface, a heel surface adjacent to said backface, and at least one circumferential row of intermeshed cutter elements axially spaced apart from said heel surface relative to the cone axis of the first cone cutter;

said first cone cutter further comprising an array of $N_1$ cutter elements mounted in a circumferential band axially disposed between said row of intermeshed cutter elements and said heel surface relative to the cone axis of the first cone cutter;

wherein said array of $N_1$ cutter elements are spaced at non-uniform radial positions relative to said bit axis and include cutting surfaces that when viewed in rotated profile, provide a first composite cutting profile having width $W_1$; and wherein said $N_1$ cutter elements are disposed in at least $P_1$, radial positions, where $P_1$ is at least five; and wherein at least one of said $N_1$ cutter elements of said array is mounted at a radial position relative to said bit axis that is different from the radial position of every other cutter element in the array.

2. The drill bit of claim 1 wherein $N_1$ is equal to $P_1$.

3. The drill bit of claim 2 wherein said $N_1$ cutter elements are arranged in at least one spiral.

4. The drill bit of claim 1 wherein at least a first and a second of said $N_1$ cutter elements are positioned in the same radial position.

5. The drill bit of claim 4 wherein said $N_1$ cutter elements are arranged in at least two spirals.

6. The drill bit of claim 1 wherein $W_2$ is not equal to $W_1$.

7. The drill bit of claim 1 wherein $N_2$ is not equal to $N_1$.

8. The drill bit of claim 1 wherein $N_2$ is greater than $N_1$, and at least one of said $N_2$ cutter elements has a cuting surface that extends further from the bit axis than the cutting surface of every cutter element of $N_1$.

9. The drill bit of claim 1 wherein said array of $N_1$ cutter elements has a radially-innermost cutter element, and wherein said overlapping first and second composite cutting profiles provide a third composite cutting profile that is substantially free of cutting voids, and wherein said third composite profile extends from said radially-innermost cutter element substantially to said heel surface.

10. A drill bit for creating a borehole in earthen formations, comprising:

a bit body having a bit axis;

a plurality of cone cutters, each of said cone cutters mounted on said bit body and adapted for rotation about a different cone axis and including a backface, a nose portion opposite said backface, a heel surface adjacent to said backface, an intermeshed region, adjacent to said nose portion, a non-intermeshed region between said intermeshed region and said backface, and at least one circumferential row of intermeshed cutter elements disposed in said intermeshed region, wherein a first of said cone cutters further includes a first array of non-intermeshed bottomhole cutter elements mounted in said non-intermeshed region in non-uniform radial positions relative to said bit axis, said non-intermeshed bottomhole cutter elements having element axes defining said radial positions and having cutting surfaces defining a first composite cutting profile having width $W_1$ when viewed in rotated profile; and wherein a second of said cone cutters further includes a second array of non-intermeshed bottomhole cutter elements mounted in said non-intermeshed region in non-uniform radial positions relative to said bit axis, said non-intermeshed bottomhole cutter elements having element axes defining said radial positions and having cutting surfaces defining a second composite cutting profile having width $N_2$ when viewed in rotated profile; and wherein said first composite profile and said second composite profile at least partially overlap when viewed in rotated profile to create a third composite profile that is substantially free of cutting voids.

11. The drill bit of claim 10 wherein said first array consists of $N_1$ cutter elements, and wherein said $N_1$ cutter elements are disposed in $N_1$ different radial positions relative to said bit axis.

12. The drill bit of claim 11 wherein said $N_1$, cutter elements are arranged in a spiral and are radially spaced apart a uniform distance.

13. The drill bit of claim 10 wherein said first ray consists of $N_1$, cutter elements, and wherein at least half of said $N_1$ cutter elements are arranged in a first spiral.

14. The drill bit of claim 10 wherein said $N_1$, cutter elements of said first array are disposed in at least five different radial positions relative to said bit axis.

15. The drill bit of claim 10 wherein said first array of non-intermeshed cutter elements are disposed in at least five different radial positions.

16. The drill bit of claim 10 wherein said second array of non-intermeshed cutter elements consists of $N_2$ cutter elements disposed in $N_2$ different radial positions relative to said bit axis, and wherein $N_2$ is not equal to $N_1$.

17. The drill bit of claim 16 wherein $N_2$ is greater than $N_1$ and wherein, when viewed in rotated profile, said composite cutting profile of width $W_2$ extends closer to gage than said composite cutting profile of width $W_1$.

18. The drill bit of claim 10 wherein said first array is closer to said bit axis than said second array, and wherein said first array includes a radially-innermost cutter element having an element axis, and wherein said non-intermeshed region of said first of said cone cutters from said element axis substantially to said heel surface.

19. The drill bit of claim 10 wherein said first array is closer to said bit axis than said second array, and wherein said first array includes a radially-innermost cutter element having an element axis, and wherein said non-intermeshed region of said first of said cone cutters extends from said element axis substantially to said backface.

20. A drill bit for drilling through earthen formations and forming a borehole the bit comprising:

a bit body having a bit axis;

at least three cone cutters, each cone cutter being mounted on said bit body and adapted for rotation about a different cone axis, and including a backface, a heel surface adjacent to said backface, and a circumferential row of intermeshed cutter elements spaced from said heel surface;

each of said cone cutters further including an array of bottomhole cutter elements mounted within a band located between said heel surface and said circumferential row of intermeshed cutter elements;

wherein said cutter elements within each array are spaced at non-uniform radial positions relative to said bit axis and include cutting surfaces that extend from their respective cone cutter and, when viewed in rotated profile, define a composite cutting profile of said array; and wherein, in rotated profile, said composite cutting profile of each array at least partially overlaps with the composite cutting profile of each of the other arrays.

21. The drill bit of claim 20 wherein a first array on a first cone includes $N_1$ cutter elements and a composite cutting profile of width $W_1$ when viewed in rotated profile, and a second array on a second cone includes $N_2$ cutter elements and a composite cutting profile of width $W_2$ when viewed in rotated profile, and wherein $N_2$ is greater than $N_1$, and $W_2$ extends closer to said gage cutter elements when viewed in rotated profile.

22. The drill bit of claim 20 wherein a first array on a first cone comprises $N_1$ cutter elements disposed in $N_1$ radial positions.

23. The drill bit of claim 20 wherein the number of cutter elements in a first array is greater than the number of cutter elements in a second array.

24. The drill bit of claim 23 wherein the composite cutting profile of said first array extends closer to said gage cutter elements than the composite cutting profile of said second array.

25. The drill bit of claim 20 wherein said overlapping cutting profiles create a total composite cutting profile, and wherein said total composite cutting profile is substantially free of cutting voids.

26. The drill bit of claim 25 wherein each of said cone cutters includes an intermeshed region and a non-intermeshed region, and wherein said total overlapping cutting profile, in rotated profile, encompasses substantially all of said non-intermeshed region of each cone cutter.

27. The drill bit of claim 25 wherein said total overlapping cutting profile, in rotated profile, extends substantially to said heel surface.

28. The drill bit of claim 25 wherein said total overlapping cutting profile, in rotated profile, extends substantially to said backface.

29. A drill bit for drilling through earthen formations and forming a borehole having a sidewall, a corner and a borehole bottom, the bit comprising:

a bit body having a bit axis;

a plurality of rolling cone cutters, each of said cone cutters mounted on said bit body and adapted for rotation about a different cone axis and having a backface, a nose region opposite said backface, and intermeshed and non-intermeshed regions which intersect at a location between said nose region and said backface;

at least one gage cutter element mounted on one of said cone cutters and positioned to cut the borehole corner; and a first array of cutter elements disposed in said non-intermeshed region of at least one of said cone cutters, said array including a plurality of bottomhole cutter elements radially offset from others in said first array, said cutter elements of said first array having cutting surfaces defining a first composite cutting profile that extends from adjacent said intersection of said intermeshed and non-intermeshed regions at least to said gage cutter element, said first composite profile being free of cutting voids.

30. The drill bit of claim 29 further comprising;

a heel surface adjacent said backface; and a second array of cutter elements disposed in said non-intermeshed region of at least one of said cone cutters, said second array including a plurality of cutter elements radially offset from others in said second array, said cutter elements of said second array having cutting surfaces defining a second composite cutting profile that is free of cutting voids and that partially overlaps with said first composite cutting profile, said second composite cutting profile extending at least substantially to said heel surface.

31. The drill bit of claim 29 wherein said first composite profile extends substantially to said backface.

32. The drill bit of claim 29 wherein each of said plurality of cone cutters includes an array of cutter elements disposed in said non-intermeshed region and including a plurality of bottomhole cutter elements radially offset from others in the array and defining a composite profile extending from adjacent to the intersection of said intermeshed and non-intermeshed regions of the cone wherein, when viewed in rotated profile, said composite cutting profile of each array at least partially overlaps with the composite cutting profile of each of the other arrays.

33. A drill bit for drilling a borehole having a sidewall, a corner, and a borehole bottom, the bit comprising:

a plurality of rolling cone cutters, each rolling cone cutter including a backface, a plurality of bottom-hole cutter elements in an intermeshed region, and a plurality of bottom-hole cutter elements in a non-intermeshed region positioned between the backface and the intermeshed region;

a first array of bottomhole cutter elements mounted in said non-intermeshed region of a first of said cone cutters, said first array of bottomhole cutter elements being disposed about the cone surface in a non-circumferential arrangement and including cutter elements being mounted at differing radial positions relative to said bit axis;

wherein all of said bottomhole cutter elements in said non-intermeshed regions of said rolling cone cutters form, in rotated profile, a total composite cutting profile that extends along the borehole bottom and is substantially free of cutting voids.

34. The drill bit of claim 33 further comprising a second array of cutter elements mounted in said non-intermeshed region of one of said cone cutters, said second array of cutter elements being disposed about the cone surface in a non-circumferential arrangement including cutter elements mounted at differing radial positions relative to said bit axis and forming, in rotated profile, a composite cutting profile that partially overlaps with said total composite profile and including cutting surfaces extending to cut the borehole corner.

35. The drill bit of claim 33 wherein said bottomhole cutter elements of said first array include at least one spiral arrangement.

36. The drill bit of claim 35 wherein said first array comprise $N_1$ cutter elements disposed in $N_1$ radial positions.

37. A drill bit for creating a borehole in earthen formations, comprising:

a bit body having a bit axis;

a plurality of cone cutters, each of said cone cutters mounted on said bit body and adapted for rotation about a different cone axis and including a backface, a nose portion opposite said backface, a heel surface adjacent to said backface, an intermeshed region, adjacent to said nose portion, a non-intermeshed region between said intermeshed region and said backface, and at least one circumferential row of intermeshed cutter elements disposed in said intermeshed region, wherein a first of said cone cutters further includes a first array of non-intermeshed bottomhole cutter elements mounted in said non-intermeshed region in non-uniform radial positions relative to said bit axis, said non-intermeshed bottomhole cutter elements having element axes defining said radial positions and having cutting surfaces defining a composite cutting profile having width $W_1$ when viewed in rotated profile; and wherein a second of said cone cutters further includes a cutter element mounted in said non-intermeshed region, said non-intermeshed bottomhole cutter element of said second of said cone cutters having a cutting surface defining a cutter element cutting profile when viewed in rotated profile; and wherein said composite cutting profile of said array and said cutter element cutting profile at least partially overlap when viewed in rotated profile to create a third composite profile that is substantially free of cutting voids.

38. The drill bit of claim 37 wherein each of said element axes of said cutter elements defining said composite profile are non-parallel when viewed in rotated profile.

* * * * *